United States Patent [19]

Takayama et al.

[11] 4,100,087

[45] Jul. 11, 1978

[54] PRESSURE-FIXING MAGNETIC DEVELOPER CONTAINING HYDROGENATED POLYSTYRENE BINDER FOR ELECTROSTATIC PHOTOGRAPHY AND PROCESS FOR PREPARATION THEREOF

[75] Inventors: Hiroshi Takayama, Moriguchi; Tatsuo Aizawa, Osaka, both of Japan

[73] Assignee: Mita Industrial Co. Ltd., Osaka, Japan

[21] Appl. No.: 758,423

[22] Filed: Jan. 11, 1977

[30] Foreign Application Priority Data

Jan. 22, 1976 [JP] Japan ..... 51/5477

[51] Int. Cl.[2] ..... G03G 9/14

[52] U.S. Cl. ..... 252/62.1 P; 96/1 SD; 159/48 R; 252/62.53; 252/62.54; 252/511; 427/18; 427/22

[58] Field of Search ..... 159/48 R; 252/62.53, 252/62.54, 62.1 P, 500, 511; 427/22, 18; 96/1 SD; 526/21, 25, 26

[56] References Cited

U.S. PATENT DOCUMENTS

| | | | |
|---|---|---|---|
| 2,384,619 | 9/1945 | Heller | 526/25 |
| 2,726,233 | 12/1955 | Warner et al. | 526/25 |
| 3,925,219 | 12/1975 | Strong | 252/62.1 P |
| 3,933,665 | 1/1976 | Van Engeland et al. | 252/62.1 P |

*Primary Examiner*—Harry J. Gwinnell
*Assistant Examiner*—John D. Smith
*Attorney, Agent, or Firm*—Sherman & Shalloway

[57] ABSTRACT

A pressure fixing developer for electrostatic photography comprising a finely divided magnetic material and a binder as effective components and consisting essentially of substantially spherical particles of said finely divided magnetic material dispersed in a solid medium of said binder, said binder medium being composed of a resin composition comprising (a) 25 to 65% by weight based on the total binder of a hydrogenated styrene resin, (b) 5 to 45% by weight based on the total binder of a wax having a melting point of at least 60° C. and (c) 10 to 30% by weight based on the total binder of a copolymer of anlefin with a carbonyl group-containing, ethylenically unsaturated monomer.

18 Claims, No Drawings

PRESSURE-FIXING MAGNETIC DEVELOPER CONTAINING HYDROGENATED POLYSTYRENE BINDER FOR ELECTROSTATIC PHOTOGRAPHY AND PROCESS FOR PREPARATION THEREOF

This invention relates to a pressure-fixing developer for electrostatic photography and a process for the preparation thereof. More particularly, the invention relates to a developer which is used for electrostatic photography or printing comprising developing an electrostatic latent image and fixing the resulting toner image by application of a pressure and which has improved adaptability to the developing operation and excellent image-forming property, and to a process for the preparation of this developer for electrostatic photography.

A so-called magnetic brush method is broadly used as one of methods for developing electrostatic latent images formed by electrostatic photography.

Toners prepared by dispersing a powder of a magnetic material such as triiron tetroxide, if necessary with additives such as a pigment, into a medium of a binder resin and molding the dispersion into particles are generally used for the magnetic brush developing method. In order to impart to these particles a property of being magnetically attractable as a whole and render the surfaces of the particles electrically conductive, an electrically conductive substance such as carbon black is embedded in the surfaces of the particles.

These magnetic toners have an advantage that clear toner images with a much reduced edge effect can be produced according to the magnetic brush developing method without using a magnetic carrier or the like.

However, these known magnetic toners are still insufficient in the flowability of the toner particles, and various problems are caused in connection with the adaptability to the developing operation and the fixing operation by poor flowability of the toner particles. For example, the known magnetic toners have not a flowability sufficient to distribute the toner particles uniformly on a developing roller (sleeve), and masses or agglomerates of the toner particles are often formed on the surface of the sleeve and they often fall on a copying sheet to contaminate the background of the obtained copy. Moreover, because of non-uniform adhesion of the toner particles on the surface of the sleeve, the resulting image is often blurred.

As means for improving the flowability in particles of magnetic toners, there is known a method in which finely divided silica is incorporated as a lubricant into particles of magnetic toners. However, since finely divided silica adhering to the peripheries of the toner particles has a relatively high electric resistance, the electric resistance of the developer as a whole is increased and therefore, such undesirable phenomena as bleeding of contours of the resulting image are readily caused to occur.

In general, at the copying operation, these magnetic toners are applied to electrostatic latent images formed on substrates and the resulting toner images are molten and fixed by heating as they are or after they have been transferred onto suitable paper substrates. However, in this heat fixing method, a long time is required for warming up a heating element to temperatures sufficient to melt binder resins and the demand for obtaining prints rapidly is not sufficiently satisfied. Moreover, since a large quantity of electric power must be used for obtaining heat necessary for copying and a special heating element must be disposed in a copying apparatus, increase of the copying cost cannot be obviated. Still further, when jamming is caused in a copying paper transfer passage, copying papers are readily scorched or burnt heat.

As means overcoming the foregoing defects and disadvantages, in the field of magnetic toners there has been proposed a method in which a pair of pressure fixing rolls are used to fix a toner image on a substrate by application of a pressure. However, known pressure fixing magnetic toners are still insufficient in the adaptability to the developing and fixing operations and in properties of the resulting images. For example, an oldest pressure fixing toner comprising a binding medium having a relatively low melting point such as wax is not satisfactory in the fixing property, and the resulting copy is defective in that a fixed image is readily peeled off when the copy is bent. Moreover, the toner of this type has a conspicuous tendency to agglomerate and cohere and is poor in the flowability, and defects such as mentioned above are readily manifested.

As means for overcoming such defects, Japanese Patent Application Laid-Open Specification No. 17739/74 proposes the use of a pressure fixing magnetic toner composed of encapsulated particles comprising a nucleus of a finely divided magnetic material, a coloring component and a soft binder polymer and a sheath of a hard polymer such as polystyrene. According to the conventional technique, since the soft binder medium is encapsulated, the agglomeration tendency of toner particles is reduced and the flowability is improved. However, since particle surfaces are covered with a highly electrically insulating resin such as polystyrene, the electric resistance of the developer is increased and troubles such as bleeding of contours of the resulting image are caused. In general, in developers having such particle structure, a so-called off-set phenomenon in which the toner image adheres to the roller surface and is thus transferred on to the toner surface is readily caused to occur at the pressure fixing step.

Japanese Patent Application Laid-Open Specification No. 50042/75 proposes the use of a hot-melt composition comprising 50 to 100 parts of a wax component and 2 to 50 parts by weight of a thermoplastic resin as a binder material (binder medium) for a magnetic toner. Since particles of the developer of this type contain a large amount of a wax component having a relatively low melting point, the agglomeration tendency is still conspicuous among the particles and defects such as mentioned above are manifested at the developing step.

We found that when a novel resin composition comprising (a) 25 to 60% by weight based on the total composition of a hydrogenated styrene resin, (b) 15 to 45% by weight based on the total composition of a wax having a melting point of at least 60° C., (c) 10 to 30% by weight based on the total composition of a copolymer of an olefin with a carbonyl group-containing, ethylenically unsaturated monomer and (d) up to 20% by weight based on the total composition of a thermosetting resin modifier such as an epoxy resin as an optional component is used as a binder medium for a magnetic developer, there can be obtained a pressure fixing magnetic developer for electrostatic photography having good adaptability to the developing and fixing operations and being excellent in properties of resulting images.

In the instant specification, all of "%" and "parts" are by weight unless otherwise indicated.

It is a primary object of the present invention to provide a pressure fixing magnetic developer for electrostatic photography which is excellent in the adaptability to the developing and fixing operations, namely a developer having a much reduced tendency of agglomeration or cohesion of particles, a excellent flowability and a good fixing property to a substrate in which off-set to the fixing press roll can be effectively prevented at the fixing step, and a process for the preparation of such developer.

Another object of the present invention is to provide a developer in which a developed toner image can be tightly fixed on a substrate only by application of a pressure and the resulting image has a high resistance to peeling even under such severe test conditions as friction and bending, and a process for the preparation of such developer.

Still another object of the present invention is to provide a pressure fixing developer for electrostatic photography in which the volume resistivity is maintained at a low level and therefore, it is possible to form a clear image with much reduced bleeding, and a process for the preparation of such developer.

In accordance with one fundamental aspect of the present invention, there is provided a developer comprising a finely divided magnetic material and a binder as effective components and consisting essentially of substantially spherical particles formed by dispersing said finely divided magnetic material in a medium of the binder, said binder medium being composed of the above-mentioned novel resin composition.

In accordance with another aspect of the present invention, there is provided a process for the preparation of pressure fixing developers for electrostatic photography comprising spraying in a drying atmosphere a starting liquid formed by dispersing a finely divided magnetic material in a solution of a binder in an organic solvent, the binder being the above-mentioned novel resin composition and the organic solvent being capable of dissolving therein all the components of the binder and having substantially constant volatility and dissolving power, thereby to obtain a developer composed of substantially spherical particles comprising the finely divided magnetic material dispersed in said binder medium in which at least surface portions of the respective particles are formed of a porous dispersion system of the magnetic material and the binder medium.

In accordance with still another aspect of the present invention, there is provided a developer for electrostatic photography consisting essentially of a dry blend of (A) substantially spherical fixing magnetosensitive particles comprising a finely divided magnetic material and a binder as effective components and being composed of a composition comprising a dispersion medium of the binder and said finely divided magnetic material dispersed in the dispersion medium of the binder and (B) flowability- and electric resistance-controlling fine particles having a volume resistivity not higher than $10^{12}\Omega$-cm and a particle size not larger than 1/10 of the particle size of said substantially spherical particles (A), said binder medium of the fixing magnetosensitive particles (A) being composed of the above-mentioned novel resin composition and having porous surfaces including fine convexities and concavities formed by spraying in a drying atmosphere a dispersion of said composition.

The present invention will now be described in detail.

BINDER COMPONENT

In the developer of the present invention, it is important that the binder medium should contain a hydrogenated styrene resin (a). This hydrogenated styrene resin is a resin obtained by hydrogenating completely or partially polystyrene having a low degree of polymerization. In general, the hydrogenated styrene resin consists of recurring units represented by the following formula:

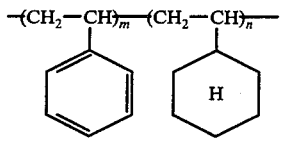

(1)

wherein the ring

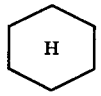

stands for a saturated 6-membered ring, $n$ is an integer of at least 1 and $m$ is zero or a number of at least 1.

The hydrogenation degree (%) of the hydrogenated styrene resin, namely the value (%) represented by the formula $100n/(n + m)$, is preferably at least 30%, especially preferably at least 50%, and when a hydrogenated styrene resin having such hydrogenation degree is employed, the electric resistance of the developer particles can be remarkably reduced and porous and rough surfaces having fine convexities and concavities can be effectively formed on the developer particles. The molecular weight of the hydrogenated styrene resin is not particularly critical, but in view of the adaptability to the pressure fixing, it is preferred that the molecular weight of the hydrogenated styrene resin be in the range of from 500 to 1000. From the same viewpoint, it is preferred that the softening point of the hydrogenated styrene resin be in the range of 85° to 150° C. Such hydrogenated styrene resins are marketed by Arakawa Rinsan Kagaku Kogyo Kabushiki Kaisha. More specifically, a hydrogenated styrene resin having a hydrogenation degree of 100% is commercially available under the tradename "Arkon P" and a hydrogenated resin having a hydrogenation degree of 50% is commercially available under the tradename "Arkon M". In general, the former resin is preferred.

This hydrogenated styrene resin is different from known binders such as polystyrene in the point that though it has a very high electric resistance, when it is used as the binder singly or in combination with a wax such as described hereinafter, the electric resistance of developer particles can be remarkably reduced. Further, at the spray-drying granulation step, this hydrogenated styrene resin in combination with a wax performs a function of forming porous rough surfaces having fine convexities and concavities on developer particles, and such porous and rough surfaces reduce the volume resistivity of the particles and have an effect of tightly holding conductive fine particles (B) sprinkled thereon according to need. Moreover, this hydrogenated styrene resin has brittleness, namely easily crumbling property, and it imparts easily crumbling property suitable for the pressure fixing to developer particles and exerts an effect of facilitating embedding of the particles in a photosensitive layer or other coating layer of a copying paper. Still further, this resin has a relatively high softening point and no tackiness, and therefore, it controls agglomeration and cohesion of developer particles and improves the adaptability of the developer to the developing operation.

In the present invention, it is important that the hydrogenated styrene resin (b) should be used in an amount of 25 to 65%, especially 30 to 60%, based on the total binder. If the content of the resin (a) is smaller than 25%, the electric resistance of the resulting developer particles is high and the image density is reduced. If the content of the resin (a) is larger than 65%, the peel resistance of the fixed image becomes insufficient.

In the present invention, it also is important that a wax component (b) should be used in an amount of 5 to 45%, especially 10 to 40%, based on the total binder in combination with the above-mentioned hydrogenated styrene resin (a). When the amount of the wax (b) is smaller than 5% or larger than 45%, the mechanical strength of developer particles tends to be reduced. Further, if the amount of the wax (b) is larger than 45%, the tendency of developer particles to agglomerate and cohere is enhanced and the adaptability to the developing operation is degraded. In contrast, if the amount of the wax (b) is smaller than 5%, the peel resistance and other properties of the resulting fixed image are degraded. This wax (b) that is used in the present invention must have a melting point of at least 60° C. As pointed out hereinbefore, when this wax (b) is used in combination with the hydrogenated styrene resin (a), it performs a function of forming porous and rough surfaces having fine convexities and concavities on developer particles. Moreover, this wax (b) alone or in combination with a thermosetting resin modifier described hereinafter, such as an epoxy resin, has an effect of improving the dispersibility of the finely divided magnetic material in the binder medium.

As the wax, any of naturally occurring waxes such as vegetable waxes, animal waxes, solid fats and mineral waxes and synthetic waxes can be used in the present invention, so far as it has a melting point of at least 60° C., preferably 65° to 125° C. If a wax having a melting point lower than 60° C. or a liquid wax is employed, the foregoing effects cannot be attained because it tends to cause agglomeration and cohesion of developer particles.

As the wax that is preferably used in the present invention, there can be mentioned, for example, waxes in a narrow sense such as carnauba wax, cotton wax, candelilla wax, sugar cane wax, bees wax and wool wax, mineral waxes such as montan wax, paraffin wax and microcrystalline wax, solid higher fatty acids having at least 6 carbon atoms, especially 16 to 22 carbon atoms, such as palmitic acid, stearic acid, hydroxystearic acid and behenic acid, amides of higher fatty acids having at least 6 carbon atoms, especially 16 to 22 carbon atoms (hereinafter the term "higher" will be used to mean the carbon number of at least 6, especially 16 to 22), oleic amide, stearic amide, palmitic amide, N-hydroxyetylhydroxystearoamide, N,N'-ethylene-bis-stearoamide, N,N'-ethylene-bis-ricinolamide and N,N'-ethylene-bis-hydroxystearylamide, alkali metal, alkaline earth metal and zinc and aluminum salts of higher fatty acids such as calcium stearate, aluminum stearate and calcium palmitate, hydrazides of higher fatty acids such as stearic hydrazide and palmitic hydrazide, p-hydroxyanilides of higher fatty acies such as myristic p-hydroxyanilide and stearic p-hydroxyanilide, hydrochlorides of β-diethylaminoethyl esters of higher fatty acids such as β-diethylaminoethyl laurate hydrochloride and β-diethylaminoethyl stearate hydrochloride, higher fatty acid amide-formaldehyde condensates such as stearic amide-formaldehyde condensate and palmitic amide-formaldehyde condensate, salt-forming reaction products of one mole of an amino group-containing dye or dye base with at least 4 moles of a higher fatty acid such as salt-forming reaction products of such dye or dye base with stearic acid, palmitic acid or myristic acid, hardened oils such as hardened castor oil and hardened beef tallow oil, and polyethylene wax and oxidized polyethylene. Of course, waxes that can be used in the present invention are not limited to those exemplified above.

In the present invention, the foregoing waxes may be used singly or in the form of a mixture of two or more of them. For example, a mixture of an animal or vegetable wax and a fatty acid or its derivatives may be used in the present invention. In view of the pressure fixing property and the porous and rough surface of the developer particle, it is preferred to use a higher fatty acid or its derivative, especially a higher fatty acid amide, as the wax.

In the present invention, it has been found that when a salt-forming reaction product of an amino group-containing dye or dye base with a higher fatty acid is used as at least a part of the wax, preferably 10 to 80% of the wax component, the dispersibility of the finely divided magnetic material in the binder medium can be further improved. Examples of the dye or dye base that can be preferably used for formation of such salt-forming reaction products are as follows:

1. Basic Azo Dyes:
   Chrysoidine Base [C. I. Solvent Orange 3 (11270B)] and Bismarck Brown G Base [C. I. Basic Brown 1 (21000)]
2. Basic Diphenylmethane Dyes:
   Auramine [C. I. Basic Yellow 2 (41000)] and Auramine Base [C. I. Solvent Yellow 34 (41000B)]
3. Basic Triphenylmethane Dyes:
   Malachite Green [C. I. Basic Green 4 (42000)], Malachite Green Base [C. I. Solvent Green 1 (42000B)], Magenta [C. I. Basic Violet 14 (42510)], Magenta Base [C. I. Solvent Red (42510B)], Methyl Violet [C. I. Basic Violet 1 (42535)], Crystal Violet [C. I. Basic Violet 3 (42555)], Crystal Violet Base [C. I. Solvent Violet 9 (42555B)], Victoria Blue [C. I. Basic Blue 26 (44045)], Victoria Blue Base [C. I. Solvent Blue (44045B)], Soluble Blue [C. I. Solvent Blue 23 (42760)] and intermediate (before sulfonation) of Patent Blue AF [C. I. Acid Blue 7 (42080)]
4. Acridine Dyes:
   Acridine [C. I. Basic Orange 14 (46005)]
5. Pyronine Dyes:
   Pyronine G [Basic Dye (45005)]
6. Rhodamine Dyes:
   Rhodamine B [C. I. Basic Violet 10 (45170)] and Rhodamine B Base [C. I. Solvent Red 49 (45170B)]
7. Acridine Derivatives:
   Phenonine AL [C. I. Basic Dye (46055)]
8. Quinoneimine dyes:
   Azine Type:
   Safranine T [C. I. Basic Red 2 (50240)], Induline [C. I. Solvent Blue 7 (50400), Nigrosine [C. I. Solvent Black 5 (50415)] and Nigrosine Base [C. I. Solvent Black 7 (50415B)]

Oxazine Type:

Meldola's Blue [C. I. Basic Blue 6 (51175)]

Thiazine Type:

Methylene Blue [C. I. Basic Blue 9 (52015)] and Methylene Blue Base [C. I. Solvent Blue 8 (52015B)]

9. Azo Type Disperse Dyes:

Celliton Fast Orange GR [C. I. Disperse Orange 3 (11005)]

10. Anthraquinone Type Disperse Dyes:

Sudan Violet R [C. I. Disperse Violet (61100)], Celliton Blue Extra [C. I. Disperse Blue 1 (64500)] and Disperse Fast Brilliant Blue B [C. I. Disperse Blue 3 (61505)]

Nigrosine or Nigrosine Base is especially preferred as the dye or dye base for formation of a salt-forming reaction product. It is especially preferred that the higher fatty acid be used in an amount of 4 to 20 moles per mole of the dye or dye base.

In order to prevent agglomeration and cohesion of developer particles and improve the adaptability to the developing operation and to improve the mechanical strength of developer particles, it is important that the binder medium in the developer of the present invention should contain a copolymer of an olefin with a carbonyl group-containing, ethylenically unsaturated monomer in an amount of 10 to 30%, especially 15 to 25%, based on the total binder. If the amount of the copolymer is smaller than 10%, the resulting developer particles readily agglomerate and cohere or the mechanical strength of the developer particles is degraded. If the amount of the copolymer is larger than 30%, the electric resistance of the developer particles becomes high.

The above copolymer that is used in the present invention is a thermoplastic resin obtained by copolymerizing an olefin such as ethylene, propylene, 1-butene or 4-methylpentene-1 with an ethylenically unsaturated monomer containing a carbonyl group in the form of a carboxylic acid, carbonamide, carboxylic acid ester or ketone. Typical instances of such ethylenically unsaturated monomer include (1) ethylenically unsaturated carboxylic acids and their anhydrides, alkyl esters and amides, such as acrylic acid, methacrylic acid, crotonic acid, maleic acid, maleic anhydride, ethyl acrylate, methyl methacrylate, 2-ethylhexyl acrylate, $\beta$-hydroxyethyl acrylate, N,N-diethylaminoethyl acrylate, acrylamide and methacrylamide, (2) vinyl esters of carboxylic acids such as vinyl formate, vinyl acetate and vinyl propionate, and (3) vinyl ketones such as methylvinyl ketone and ethylvinyl ketone.

The copolymer that is used in the present invention comprises, in addition to the above-mentioned olefin and carbonyl group-containing, ethylenically unsaturated monomer, other copolymerizable unsaturated monomer such as styrene, butadiene, methylvinyl ether, vinyl alcohol, acrylonitrile, methacrylonitrile or vinyl chloride in an amount not damaging essential characteristics of the copolymer, generally in an amount of up to 30 mole %, especially in an amount of up to 10 mole %, A copolymer that is preferably used in the present invention comprises (i) olefin recurring units represented by the following formula:

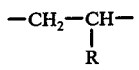

wherein R stands for a hydrogen atom or a lower alkyl group (the term "lower" is used to mean the carbon number of up to 4 in the instant specification), and (ii) recurring units represented by the following formula:

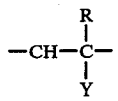

wherein R is as defined above and Y stands for $-CONH_2$, —COOH, —COOR (in which R is as defined above), $-COOM_{1/m}$ (in which M stands for a cation and $m$ is the valency of the cation M), —O—OCR (in which R is as defined above) or —CO—R′ (in which R′ stands for a lower alkyl group), and/or recurring units represented by the following formula:

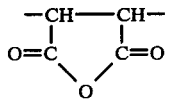

In the copolymer that is used in the present invention, it is preferred that the content of the olefin recurring units be 70 to 97 mole %, especially 85 to 94 mole % and the content of the carbonyl group-containing monomer units be 3 to 30 mole %, especially 6 to 15 mole %. More specifically, a copolymer having such composition has, in general, a good compatibility with waxes such as mentioned above and preferred effects of lowering the electric resistance of developer particles and improving the mechanical strength of developer particles.

The copolymer that is used in the present invention may be a random copolymer, a block copolymer or a graft copolymer. The molecular weight of the copolymer is not particularly critical, but in general, in order to obtain developer particles having a much reduced tendency to agglomerate and cohere and being excellent in the mechanical strength and fixing property, it is preferred that the logarithmic viscosity number of the copolymer be in the range of from 0.1 to 2.0, especially from 0.4 to 1.5, as measured in toluene at a temperature of 30° C. and a concentration of 0.25 g/100 ml.

Copolymers that are preferably used for attaining the objects of the present invention are ethylene/vinyl acetate copolymers, partially saponified and acetalized ethylene/vinyl acetate copolymers, ethylene/acrylic acid copolymers, acrylic acid-grafted polyethylene, ethylene/methyl methacrylate/acrylic acid copolymers, maleic acid-modified polypropylene and ionomers. Among these copolymers, ethylene/vinyl acetate copolymers are especially preferred.

The binder medium of the developer of the present invention may comprise as an optional component a resin modifier composed of at least one thermosetting resin selected from an epoxy resin, a xylene resin, a phenolic resin, a urea resin, a melamine resin, a urethane resin, an alkyd resin and a maleimide resin in an amount of up to 20%, especially up to 15%, based on the total binder. By incorporation of such resin modifier, the dispersibility of the finely divided magnetic material into the binder medium and the peel resistance and durability of the resulting image can be further improved.

An epoxy resin is especially preferred as such thermosetting resin modifier. As the epoxy resin, there can be used, for example, bis-epoxy and tris-epoxy compounds obtained by reacting a polyhydric phenol, a polyhydric alcohol or a resol-type phenolic resin with an epihalohydrin. A typical epoxy resin is one represented by the following formula:

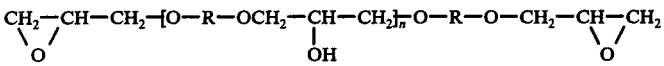

wherein R stands for a residue derived from 2,2-bis(4-hydroxyphenyl)propane (bisphenol A).

In general, it is preferred to use an epoxy resin having an epoxy equivalent of 400 to 3000, espcially 500 to 2000.

OTHER COMPONENTS OF DEVELOPER

As magnetic materials heretofore used in this field, there can be mentioned, for example, triiron tetroxide ($Fe_3O_4$), diiron trioxide ($\gamma$-$Fe_2O_3$), zinc iron oxide ($ZnFe_2O_4$), ytterium iron oxide ($Y_3Fe_5O_{12}$), cadmium iron oxide ($CdFe_2O_4$), copper iron oxide ($CuFe_2O_4$), lead iron oxide ($PbFe_{12}O_{19}$), nickel iron oxide ($NiFe_2O_4$), medium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and the like. In this invention, at least one member selected from the foregoing magnetic materials is used in the finely divided state, and use of triiron tetroxide as the magnetic material is especially preferred for attaining the intended objects of this invention.

In view of the dispersibility, it is preferred that the average particle size of the finely divided magnetic material be smaller than 1000 m$\mu$, especially smaller than 500 m$\mu$.

In order to obtain developer particles excellent in the magnetically attractable property and pressure fixing property, it is preferred that the finely divided magnetic material be used in an amount of 100 to 350 parts, especially 150 to 300 parts, per 100 parts of the binder medium. When the amount of the finely divided magnetic material is smaller than 100 parts per 100 parts of the binder medium, the electric resistance of developer particles becomes high, and when the amount of the finely divided magnetic material is larger than 350 parts per 100 parts of the binder medium, the mechanical strength of developer particles is degraded.

In order to improve the color or hue of the developer particles and to extend the developer particles, various dyes, pigments and extender pigments may be incorporated in the present invention. Suitable examples of these dyes, pigments and extender pigments are as follows:

Black Pigments:

Carbon black, acetylene black, lamp black and Aniline Black

Yellow Pigments:

Chrome yellow, zinc yellow, cadmium yellow, yellow iron oxide, Mineral Fast Yellow, nickel titanium yellow, Nablus Yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake Orange Pigments:

Chrome orange, molybdenum orange, Permanent Orange GTR, Pyrazolone Orange, Balkan Orange, Indanthrene Brilliant Orange RK, Benzidine Orange G and Indanthrene Brilliant Orange GK Red Pigments:

Red iron oxide, cadmium red, red lead, cadmium mercury sulfide, Permanent Red 4R, Lithol Red, Pyrazolone Red, Watchung Red Calcium salt, Lake Red D, Brilliant Carmine 6B, Eosine Lake, Rhodamine Lake B, Alizarine Lake and Brilliant Carmine 3B Violet Pigments:

Manganese Violet, Fast Violet B and Methyl Violet Lake

Blue Pigments:

Ultramarine, cobalt blue, Alkali Blue Lake, Victoria Blue Lake, Phthalocyanine Blue, metal-free Phthalocyanine Blue, partially chlorinated Phthalocyanine Blue, Fast Sky Blue and Induthrene Blue BC Green Pigments:

Chrome Green, chromium oxide, Pigment Green B, Malachite Green Lake and Fanal Yellow Green G White Pigments:

Zinc flower, titanium oxide, antimony white and zinc sulfide

Extender Pigments:

Baryte powder, barium carbonate, clay, silica, white carbon, talc and alumina white Dyes (basic, acidic, disperse and direct dyes):

Nigrosine, Methylene Blue, Rose Bengale, Quinoline Yellow and Ultramarine Blue

It is preferred that these pigments and extender pigments have a particle size equal to or smaller than the size of the finely divided magnetic material, and that they be used in an amount smaller than 30% by weight, especially smaller than 25% by weight, based on the binder medium.

In the present invention, it is especially preferred that carbon black be chosen among the above-mentioned pigments and be used in an amount of 5 to 25%, particularly 8 to 20%, based on the binder medium.

PREPARATION OF DEVELOPER PARTICLES

The developer of the present invention is preferably prepared according to the following method. Namely, a starting liquid is formed by dispersing the above-mentioned finely divided magnetic material in a solution of the binder in an organic solvent and this starting liquid is sprayed in a drying atmosphere.

In order to obtain developer particles having good adaptability to the developing and fixing operations and having a volume resisitivity maintained at a very low level, it is necessary that the following points must be taken into consideration as well as the use of the binder medium having the above-mentioned specific composition.

In the first place, the organic solvent that is used in the present invention, of course, must be capable of dissolving therein all the components of the binder, and it must have substantially constant volatility and dissolving power. By the term "organic solvent having substantially constant volatility and dissolving power" used herein, it is meant that the solvent must not be a mixture of a plurality of components differing in the volatility or dissolving power. For example, according to the conventional micro-encapsulation method, a mixed solvent of components differing in the volatility and dissolving power, for example, cyclohexane and chloroform, is used and at the spraying franulation step, micro-encapsulation is accomplished by using as the nucleus the solute insoluble in the solvent having a lower volatility and as the shell the solute easily soluble in said solvent. When such mixed solvent of a plurality of solvents differing in the volatility and dissolving power is used as the solvent for the binder medium, the surfaces of the developer particles are coated (encapsulated) with a resin having a high electric resistance, and in this case, the improvements intended in the present invention can hardly be attained. In contrast, when according to the present invention, a solvent having substantially constant volatility and dissolving power is used and the starting liquid of the binder medium containing the finely divided magnetic material is spray-dried, granulation and dring are advanced while a relatively homogeneous dispersion state of the respective binder components is maintained.

In the present invention, as the organic solvent, there are preferably employed aromatic organic solvents such as benzene, toluene, xylene, tetrahydronaphthalene and ethyl benzene, and use of toluene is especially preferred. In addition, any of known solvents, for example, alicyclic hydrocarbon solvents such as cyclohexane, cyclic ethers such as tetrahydrofuran, esters such as amyl acetate and cellosolves such as butyl cellosolve, so far as it is capable of dissolving therein all of the above-mentioned components of the binder. Of course, a mixture of two or more of such solvents may be used in the present invention, if there is no substantial difference of either the volatility or the dissolving power, although use of such mixture is ordinarily unnecessary.

In order to obtain spherical particles suitable as developer particles, it is preferred that such organic solvent be used in an amount 3 to 20 times, especially 5 to 15 times, as large as the amount of the binder medium on the weight basis. The order of dissolving the respective components of the binder and dispersing the finely divided magnetic material is not particularly critical. For example, there may be adopted a method in which the finely divided magnetic material and a pigment or the like are dispersed in a solution formed by dissolving all the components of the binder in an organic solvent, or a method in which the finely divided magnetic material and a pigment or the like are dispersed in a solution formed by dissolving some of the components of the binder in an organic solvent and the resulting dispersion is mixed with a solution formed by dissolving the remaining components of the binder in the organic solvent.

The components of the binder used in the present invention have a higher affinity with the finely divided magnetic material such as triiron tetroxide in an order of (1) a wax such as a higher fatty acid amide or other fatty acid derivative, (2) a thermosetting resin modifier such as an epoxy resin and (3) a hydrogenated styrene resin. Accordingly, in the present invention, it is preferred that the finely divided magnetic material be coated in advance with at least one component selected from the foregoing components (1) to (3) by treating the finely divided magnetic material with a solution of such components of the binder. For example, it is possible to adopt a method in which the finely divided magnetic material is dispersed in a solution of the wax (b) or the like in an organic solvent and the resulting dispersion is intimately mixed with a solution of other binder components in the organic solvent. Of course, the same effects can be similarly attained even when the finely divided magentic material is dispersed in a solution of all the binder components in an organic solvent.

According to the present invention, the so-formed organic solvent of the binder containing dispersed therein the finely divided magnetic material is sray-dried. The starting liquid to be subjected to spray drying is maintained at such a temperature that the binder components are dispersed in the organic solvent as homogeneously and uniformly as possible. In general, it is preferred that the starting liquid be maintained at 40° to 110° C., especially 45° to 90° C.

In this invention, as the drying atmosphere there are employed various gases, such as air, nitrogen, carbon dioxide gas and combustion gas, heated at 110° to 170° C., especially gases heated at a temperature higher than the boiling point of the solvent used. A dispersion of the fine powder of the magnetic material and the binder medium is sprayed into such drying atmosphere.

The pressure of the drying atmosphere may be atmospheric pressure, but in order to adjust the evaporation rate of the solvent, the pressure may be reduced to 10 mm $H_2O$ (gauge).

Various known means may be adopted for spraying the above dispersion in the drying atmosphere. For example, there can be used a one-fluid or two-fluid nozzle, a centrifugal spray nozzle comprising a rotary member having a number of holes formed on the circumferential wall thereof, a rotary disc and the like.

According to the process of the present invention, at the spray-drying granulation step, the above-mentioned high temperature gas acts as a dispersion medium and the sprayed dispersion is formed into spherical particles, and the solvent is evaporated into the high temperature gas current from the so formed spherical particles. The reason why porous and rough surfaces having fine convexities and concavities are formed on the developer particles according to the process of the present invention is believed to be as follows:

Evaporation of the solvent from the spherical particles of the sprayed dispersion first starts from the surface portions and the solvent in the interior is gradually evaporated. In these surface portions of the spherical particles, one of a phase composed mainly of the binder component having no substantial film-forming property (the wax) and a phase composed mainly of the binder component having a film-forming property (for example, a carbonyl group-containing olefin copolymer) is present as the continuous phase and the other phase is present as the dispersed phase. In the phase composed mainly of the binder component having no substantial film-forming property, namely the wax, a great number of holes and concavities are formed by breakage or shrinkage caused with evaporation of the solvent. This phenomenon is enhanced and promoted as the solvent in the interiors of the spherical particles is evaporated and the volumes of the spherical particles are contracted. Thus, in the surfaces of the developer particles of the present invention, pores and fine convexities and concavities are formed. It is believed that by virtue of such specific porous and rough surfaces having fine convexities and concavities, a reduced tendency of agglomeration and cohesion and a low electric resistance can be attained in combination.

The particle size of the so formed spherical particles is changed depending on such factors as the solid concentration and viscosity of the dispersion to be sprayed, the speed of spraying the dispersion and the temperature and velocity of the drying atmosphere. In this invention, it is preferred that these conditions be set so that the resulting spherical particles have an average particles size of 5 to 50 microns, especially 10 to 30 microns, and they have such a particle size distribution that particles having a particle size larger than 30 $\mu$ occupy up to 10% of the total particles and particles having a particle size smaller than 10 $\mu$ occupy up to 15% of the total particles.

The so obtained developer particles are, if desired, dried under reduced or atmospheric pressure under such conditions such that substantial fusion of the binder medium is not caused, whereby the remaining solvent can be removed from the particles. Then, the particle size is adjusted by sieving or the like according to need and the final product is thus obtained.

DEVELOPER

The pressure-fixing developer of the present invention for electrostatic photography consists essentially of substantially spherical particles of a finely divided magnetic material dispersed in a binder medium, wherein, as pointed out hereinbefore, the binder medium is composed of a composition comprising (a) 25 to 65% by weight based on the composition of a hydrogenated styrene resin, (b) 5 to 45% by weight based on the composition of a wax having a melting point of at least 60° C., (c) 10 to 30% by weight based on the composition of a copolymer of an olefin with a carbonyl group-containing, ethylenically unsaturated monomer and (d) up to 20% by weight based on the composition of a thermosetting resin modifier as an optional component.

Since this developer is prepared according to the above-mentioned spray-drying granulation process, on the surfaces of the spherical particles, (1) a phase composed mainly of the wax and (2) a phase composed mainly of the carbonyl group-containing olefin copolymer are present in such mingled state that one of these phases (1) and (2) is a continuous phase and the other phase is a dispersed state. Further, in the phase (1) composed mainly of the wax, there are formed pores and concavities. This is a conspicuous micro-structural characteristic of the developer of the present invention. Whether the phase (1) or (2) is present as the continuous phase is determined by the composition of the binder medium and other factors. In general, in view of the adaptability of the developer to the developing operation, it is preferred that the phase (2) composed mainly of the carbonyl group-containing olefin copolymer be present as the continuous phase on the surfaces of the developer particles.

The finely divided magnetic material and a pigment optionally added, such as carbon black, have a good compatibility with the wax and hydrogenated styrene resin among the binder components. It is believed that the finely divided magnetic material, hydrogenated styrene resin and pigment are uniformly and intimately incorporated and distributed in the phase (1) composed mainly of the wax and this phase (1) composed of such homogeneous mixture forms a continuous matrix connected to the interior of the spherical particle.

By virtue of such structural characteristics, the developer of the present invention has a much lower volume resistivity and a higher off-set preventing effect at the pressure fixing step than the known micro-encapsulated developers.

In fact, it has been confirmed that the developer of the present invention has an electric resistance corresponding to $1/10^4$ or less of those of known microencapsulated developers and the volume resistivity of the developer of the present invention generally is in the range of $10^3$ to $10^{11}$ $\Omega$-cm, preferably $10^4$ to $10^8$ $\Omega$-cm.

Since the developer particles of the present invention have porous surfaces having fine convexities and concavities, namely crater-like rough surfaces, they have an oil absorption of 25 to 40, especially 28 to 35.

The oil absorption referred to in the instant specification is one determined according to JIS K-5101 in the following manner:

A sample (10 g) is charged in a beaker, and purified linseed oil is gradually added dropwise to the sample. Every time a prescribed amount of linseed oil is added, the mixture is kneaded by a glass rod. This dropping and kneading operation is continued until the mixture is drawn upwardly in a rod-like form when the kneading rod is lifted up from the mixture and linseed oil is in the state oozing out on the surface of the rod-like mixture. The oil absorption is calculated according to the following equation:

$$\text{Oil Absorption} = A \times 100/B$$

wherein A stands for the amount (g) of linseed oil added dropwise to the sample and B denotes the amount (g) of the sample.

COMPOSITE DEVELOPER

According to a preferred embodiment of the present invention, the so prepared substantially spherical particles (developer) are used as fixing magneto-sensitive particles (A) and dry-blended with flowability- and electric resistance-controlling fine particles (B) detailed hereinafter, whereby the flowability and electric characteristics are further improved.

As the flowability- and electric resistance-controlling fine particles (B), there can be employed, carbon black, inorganic fine particles which are non-conductive in themselves but are subjected to the electrically conductive treatment, and various metal powders.

As the carbon black having a particle size not larger than 3 $\mu$ and a volume resistivity not higher than $10^{12}$ $\Omega$-cm, there can be used, for example, furnace black for rubbers, channel black for cells or rubbers and channel black for pigments. Especially preferred carbon black includes conductive carbon black Corax-L manufactured by Degussa Co. and Vulcan XC-72R manufactured by Cabot, Inc.

Further, particles of metal oxides such as diiron trioxide, triiron tetroxide and dinickel trioxide and ultrafine particles of metals such as iron, cobalt, copper, silver, gold, aluminum and tin can also be used as the particles (B). Moreover, inorganic substances such as silicon dioxide, activated clay, acid clay, kaolin, alumina powder and zeolite, which are non-electrolytically plated with such metals as gold, silver and copper, may be used as the flowability- and electric resistance-controlling fine particles (B) in this invention.

As the inorganic fine particles (carrier particles), there are preferably employed those having a good flowability and a capacity of absorbing or adsorbing therein a surface active agent, a dye and a conductive resin. For example, silicon dioxide, activated clay, acid clay, kaolin, alumina powder and zeolite are preferably employed. It is preferred that the particle size of such carrier particles be smaller than 1/10 of the particle size of the spherical particles (A), especially smaller than 4 $\mu$, especially preferably smaller than 0.1 $\mu$.

As suitable examples of silicon dioxide particles, there can be mentioned Aerosil 200, Aerosil R972, Silica D17 and Sipernat 17 manufactured by Nippon Aerosil K. K. Fine particles of acid clay, kaolin and zeolite can also be preferably used as the carrier particles.

A solvent suitable for absorbing or adsorbing a surface active agent, a conductive resin or a dye on such inorganic carrier particles is one capable of dissolving therein a treating agent such as mentioned above but incapable of dissolving therein the carrier particles. Moreover, the solvent is desired to have such a property that it volatilizes by drying and is not substantially left in the carrier particles after drying.

As such solvent, there can be mentioned, for example, lower alcohols such as methanol, ethanol and propanol, ketones such as acetone, ethers such as tetrahydrofuran and dioxane, amines such as morpholine and pyrrolidone, sulfoxides such as dimethylsulfoxides, aromatic hydrocarbons such as benzene, toluene and xylene, halogenated hydrocarbons such as chloroform, carbon tetrachloride, trichlene, perchlene and freon, esters such as ethyl acetate and amyl acetate, and water. These solvents may be used singly or in the form of a mixture of two or more of them.

A dye dissolved in such solvent is absorbed or adsorbed on the carrier particles. The kind of the dye is not particularly critical and substantially all of dyes can be used.

For example, direct dyes, basic dyes, acid dyes, mordant dyes, reactive dyes, acid mordant dyes, fluorescent dyes and oil-soluble dyes can be used. Specific examples that are used in this invention are Direct Black 51, Basic Blue 9, Acid Red 94, Bromophenol Blue, Mordant Black 7, Reactive Red 6, Disperse Red 17, Solvent Red 24, Fluorescent Blightening Agent 30 and the like.

Suitable examples of surface active agents and conductive resins (hereinafter referred to as "treating agents") are as follows:

A. Organic Conducting Agents:

(1) Cationic Conducting Agents:

(1-a) Amine Type Conducting Agents:

Primary, secondary and tertiary alkylamines, cycloalkylamines and alkanolamines, their acid addition salts with carboxylic acids, phosphoric acid or boric acid, and polyalkyleneimines, amideamines and polyamines and their complex metal salts.

(1-b) Imidazoline Type Conducting Agents:

1-Hydoxyethyl-2-alkylimidazolines and the like.

(1-c) Amine-Ethylene Oxide Adducts and Amine-Propylene

Oxide Adducts:

Adducts of ethylene oxide, propylene oxide or other alkylene oxide to mono- or di-alkanolamines, long-chain ($C_{12}$ to $C_{22}$) alkylamines or polyamines.

(1-d) Quaternary Ammonium Salts:

Quaternary ammonium salts represented by the following general formula:

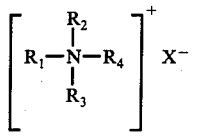

wherein $R_1$ to $R_4$, which may the same or different, stand for an alkyl group with the proviso that at least 2 of $R_1$ to $R_4$ stand for a lower alkyl group and at least one of $R_1$ to $R_4$ stands for an alkyl group having at least 6 carbon atoms, preferably at least 8 carbon atoms, and $X^-$ denotes a halide ion, and quaternary ammonium salts represented by the following general formula:

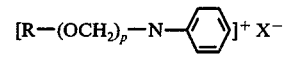

wherein R stands for an alkyl group having at least 12 carbon atoms, $p$ is 0 or 1, and X stands for a halide ion.

(1-e) Other Cationic Conducting Agents:

Cationic polymers formed by quaternizing polymers of aminoalcohol esters of ethyleneically unsaturated carboxylic acids (such as a quaternary ammonium type polymer of diethylaminoethyl methacrylate), acrylamide derivatives (such as a quaternary ammonium type polymer of N,N-diethylaminoethyl acrylamide), vinyl ether derivatives (such as pyridium salt of polyvinyl-2-chloroethyl ether), nitrogen-containing vinyl derivatives (such as a product formed by quaternizing poly-2-vinylpyridine with p-toluenesulfonic acid), polyamine resins (such as polyethylene glycol polyamine), and polyvinylbenzyltrimethyl ammonium chloride.

(2) Anionic Conducting Agents:

(2-a) Sulfonic Acid Type Conducting Agents:

Alkylsulfonic acids, sulfated oils, and salts of higher alcohol sulfuric acid esters.

(2-c) Carboxylic Acid type Conducting Agents:

Adipic acid and glutamic acid.

(2-c) Phosphoric Acid Derivative Conducting Agents:

Phosphonic acid, phosphinic acid, phosphite esters and phosphate ester salts.

(2-d) Other Anionic Conducting Agents:

Homopolymers and copolymers of ethylenically unsaturated carboxylic acids (such as polyacrylic acid and copolymers of maleic anhydride with comonomers such as styrene and vinyl acetate), and homopolymers and copolymers of sulfonic acid group-containing vinyl compounds (such as polyvinyltoluenesulfonic acid and polystyrenesulfonic acid).

(3) Non-Ionic Conducting Agents:

(3-a) Polyether Type Conducting Agents:

Polyethylene glycol and polypropylene glycol.

(3-b) Alkylphenol Adduct Type Conducting Agents:

Adducts of ethylene oxide or propylene oxide to alkylphenols.

(3-c) Alcohol Adduct Type Conducting Agents:

Adducts of ethylene oxide or propylene oxide to alcohols (such as a higher alcohol-ethylene oxide adduct).

(3-d) Ester Type Conducting Agents:

Butyl, amyl and glycerin esters of higher fatty acids such as adipic acid and stearic acid.

(3-e) Amide Type Conducting Agents:

Higher fatty acid amides, dialkyl amides, and adducts of ethylene oxide or propylene oxide to these amides.

(3-f) Polyhydric Alcohol Type Conducting Agents:

Ethylene glycol, propylene glycol, glycerin, pentaerythritol and sorbitol.

(4) Amphoteric Conducting Agents:

Betain type conducting agents, imidazoline type conducting agents and aminosulfonic acid type conducting agents.

B. Inorganic Conducting Agents:

Alkaline earth metal halides such as magnesium chloride and calcium chloride, inorganic salts such as zinc chloride and sodium chloride, chromium complexes of the Werner type in which trivalent chromium is coordinated with a monobasic acid, and hydrolysis products such as chlorosilane and silicon tetrachloride.

Treating agents exemplified above may be used singly or in the form of a mixture of two or more of them.

A treating agent such as exemplified above is dissolved in a liquid medium substantially incapable of dissolving the carrier particles to be treated, so that the concentration of the treating agent is maintained at a suitable level, for example, 0.1 to 0.5%. Then, the surface treatment of the carrier particles is performed by dipping the particles into the so formed solution of the treating agent or spraying the solution on the carrier particles.

The above-mentioned spherical fixing magnetosensitive particles (A) are dry-blended with the so prepared flowability- and electric resistance-controlling fine particles (B) at a mixing weight ratio (A) : (B) in the range of from 10000 : 1 to 50 : 1, preferably from 2000 : 1 to 100 : 1. When this mixing ratio (A) / (B) is smaller than 50 / 1, as illustrated in Comparative Example 2 given hereinafter, the adsorption or adhesion of the fine particles (B) onto the spherical particles (A) becomes insufficient and contamination of the background of the developed copy is often caused to occur. Further, the fixing property of the resulting developer tends to be degraded. If the above mixing ratio (A) / (B) is larger than 1000 / 1, the improvement of the adaptability of the developer or the electric characteristics is often insufficient.

In this preferred embodiment of the present invention, an excellent flowability and a low volume resistivity are attained in the developer merely by dry-blending the fixing magneto-sensitive particles (A) with the flowability- and electric resistance-controlling fine particles (B) such as carbon black, an when this developer is used, contamination of the background is not caused at the developing step. This fact is quite surprising. When magnetic toner particles are merely dry-blended with carbon black and the resulting dry blend is used as the developer for an electrostatic latent image, carbon black particles separating from the magnetic toner particles adhere to the background and degrade the sharpness of the resulting copy. For this reason, in the conventional magnetic toners, such a troublesome operation as of embedding carbon black in the surfaces of the magnetic toner particles. In contrast, according to the present invention, merely by dry-blending both the particles (A) and (B) and applying the dry blend on a photosensitive layer having an electrostatic latent image, as illustrated in Examples given hereinafter, no contamination of the background is caused but the flowability of the developer is remarkably improved and a toner image having no bleeding can be obtained. We believe that the reason is that since the fixing magnetosensitive particles (A) have the above-mentioned porous and rough surfaces having fine convexities and concavities, because of such specific conditions of the particles (A), the fine particles (B) such as carbon black particles sprinkled on the particles (A) by dry blending are hardly isolated from the surfaces of the particles (A), and that the particles (B) adhering to the surfaces of the particles (A) have a function of controlling the flowability and electric resistance of the particles (A).

USES

The developer of the present invention can be advantageously applied to various electrostatic photographical processes. For example, the developer of the present invention can be applied to a process comprising holding a solid fine powdery developer on the surface of a developer-holding cylindrical member and applying said developer onto the surface of an electrostatically charged latent image-holding member to visualize said latent image.

Most preferably, the developer of this invention can be applied to a method for developing electrostatic latent images, proposed by us previously Laid-open Publication No. 16926/76 on Feb. 10, 1976, and corresponding to U.S. application Ser. No. 599,953 filed on July 29, 1975 now U.S. Pat. No. 4,081,571, which comprises holding a finely divided solid developer on the surface of a developer-holding cylindrical member and applying the developer to the surface of an electrostatic latent image-holding member to thereby visualize the electrostatic latent image, wherein the surface of the developer-holding member is caused to have rolling contact with the surface of the electrostatic latent image-holding member through the developer while moving both the surfaces at the substantially same speed, the surface of the developer-holding member is brought close to the electrostatic latent image-holding member so that a resorvoir zone for the developer is formed at least upstream of the position of said rolling contact, and wherein a physical turbulence is given to particles of the developer in said reservoir zone for the developer.

A copying paper having a developed toner image is ordinarily fed between press rollers under a pressure of 200 to 900 Kg/roll and fixation is accomplished by this pressure.

The present invention will now be described in detail by reference to the following Examples that by no means limit the scope of the invention.

EXAMPLE 1

A composition comprising 45 parts by weight of Arkon P-125 (hydrogenated styrene resin manufactured by Arakawa Rinsan Kagaku Kogyo Kabushiki Kaisha), 10 parts by weight of Nigrosine stearate (salt formed from 1 part by weight of Nigrosine Base and 4 parts by weight of stearic acid), 25 parts; by weight of Amide AP-1 (fatty acid amide having a melting point higher than 98° C., manufactured by Nippon Kasei Kabushiki Kaisha) and 20 parts by weight of Evaflex 420 (ethylenevinyl acetate copolymer manufactured by Mitsui Polychemical Kabushiki Kaisha) was dissolved under agitation in 1000 parts by weight of heated toluene. Then, 250 parts by weight of triiron tetroxide and 12 parts by weight of carbon black were added to the above solution. The mixture was blended and dispersed for 30 minutes by using a homogenizing mixer to obtain a dispersion for spray drying. The dispersion being maintained at 70° C. was sprayed in a hot air current heated at 150° C. to obtain dry spherical fine particles. The particles were then classified to collect particles having a size of 5 to 25 μ, and 0.08 part by weight of carbon black was added to the so collected particles and the mixture was homogeneously blended by a V-type mixer to obtain a toner. By using the so prepared toner and a copying machine provided with a pressure fixing device (Mita Copystar Model 350D manufactured by Mita Industrial Co.), the copying operation was carried out. A sharp fixed image having a high contrast was obtained on a zinc oxide photosensitive paper.

PREPARATION OF COMPARATIVE SAMPLES:

Resinous materials used in Example 1 were blended at ratios indicated below and comparative samples A, B, C, D, E and F were prepared in the same manner as described above.

| Materials Used | Comparative Samples (parts by weight) | | | | | |
|---|---|---|---|---|---|---|
| | A | B | C | D | E | F |
| Arkon P-125 | 20 | 85 | 80 | 30 | 55 | 30 |
| Nigrosine stearate | 15 | 2 | 1 | 20 | 15 | 8 |
| Amide AP-1 | 25 | 3 | 2 | 40 | 25 | 12 |
| Evaflex 420 | 40 | 10 | 17 | 10 | 5 | 50 |
| Triiron tetroxide | 250 | 250 | 250 | 250 | 250 | 250 |
| Carbon black | 12 | 12 | 12 | 12 | 12 | 12 |

Properties of developers obtained in the foregoing Example 1 and comparative samples and images obtained by using these developers were examined and evaluated in the following manners. Obtained results are shown in Table 1.

(A) Image Quality:

The copying operation was carried out by using Mita Copystar Model 350D, and the image density and fog were evaluated.

IMAGE DENSITY

By the term "image density" is meant a reflection density of the image. The image density was evaluated according to the following scale:

○ : reflection density higher than 1.5

Δ: reflection density of 1 to 1.5

X: reflection density lower than 1

FOG

By the term "fog" is meant a phenomenon in which the background is contaminated with specks or dots. The fog was evaluated according to the following scale:

○: no fog

Δ: slight fog

X: extreme fog (B) Flowability:

The copying operation was carried out by using Mita Copystar 350D, and the feeding property, agglomerating property and clogging property were examined based on the flow of the toner on the developing roller. The flowability was evaluated according to the following scale:

○: image quality was constant at the continuous printing operation

X: uniform development was not attained at the continuous printing operation and large specklike contaminations appeared (C) Fixing Property:

The fixing property of the image to the copying sheet was examined.

ADHERENCE

An adhesive cellophane tape was applied to the fixed image and the tape was peeled at an angle of 45° and a speed of 1 cm/10 sec. The adherence was evaluated according to the following scale:

○ : thinly peeled

Δ: peeled substantially by half

X: extirely peeled

RESISTANCE TO PEELING BY BENDING

The copy was bent and the fixed image was lightly rubbed with gauze. The resistance was evaluated according to the following scale:

○ : Not peeled

Δ: partially peeled

X: white line was formed on the bending line (completely peeled)

(D) Off-Set Resistance:

By the term "off-set" is meant a phenomenon in which the image is transferred onto a pressure fixing metal roller or the image transferred onto the fixing roller is re-transferred onto a copy. The off-set resistance was evaluated according to the following scale:

○ : transfer was not caused

X: transfer was caused

Table 1

| | Image Quality | | | Fixing Property | | |
|---|---|---|---|---|---|---|
| | Image Density | Fog | Flowability | Adherence | Resistance to Peeling by Bending | Off-Set Resistance |
| Example 1 | ○ | ○ | ○ | ○ | ○ | ○ |
| Comparative Sample A | X | X | X | ○ | ○ | ○ |
| Comparative Sample B | ○ | ○ | ○ | ○ | ○ | ○ |
| Comparative Sample C | ○ | ○ | ○ | X | X | X |
| Comparative Sample D | ○ | ○ | ○ | X | X | X |
| Comparative Sample E | Δ | ○ | X | ○ | ○ | ○ |
| Comparative Sample F | ○ | ○ | X | ○ | ○ | ○ |
| | X | X | ○ | ○ | ○ | ○ |

EXAMPLE 2

A composition comprising 60 parts by weight of Arkon P-125, 20 parts by weight of Diamit 0-200 (fatty acid amide having a melting point higher than 71° C., manufactured by Nippon Kasei Kabushiki Kaisha) and 20 parts by weight of Evaflex 410 (ethylene-vinyl acetate copolymer manufactured by Mitsui Polychemical Kabushiki Kaisha) was dissolved under agitation in 800 parts by weight of heated toluene. Then, 260 parts by weight of triiron teroxide and 15 parts by weight of carbon black were added to the above solution and dispersed therein for 30 minutes by using a homogenizing mixer to obtain a dispersion for spray drying. The dispersion being maintained at 70° C. was sprayed in a hot air current heated at 150° C. to obtain dry spherical fine particles. In the same manner as described in Example 1, the particles were classified and 0.08 part by weight of carbon black was added to and dry-blended with the particles to obtain a toner. The copying operation was carried out by using this toner and Mita Copystar Model 350D. A sharp image having a high contrast was obtained without occurrence of the off-set phenomenon. The fixed image had a high adherence, and it had a high resistance to peeling and was not peeled at all by bending.

EXAMPLE 3

A composition comprising 35 parts by weight of Arkon P-125, 15 parts by weight of Epikote 1002 (epoxy resin manufactured by Shell Chemical Co.), 17 parts by weight of Diamit 0-200, 18 parts by weight of Amide AP-1 and 20 parts by weight of Evaflex 420 was dissolved in 800 parts by weight of heated toluene, and 250 parts by weight of triiron tetroxide and 13 parts by weight of carbon black were incorporated and dispersed in the solution for 30 minutes by using a homogenizing mixer to obtain a dispersion for spray drying. In the same manner as described in Example 1, a toner was prepared from this dispersion. The so prepared toner was printed on a photosensitive paper for an offset printing master and the offset printing was carried out. Good prints were obtained without peeling of the image.

EXAMPLE 4

A composition comprising 60 parts by weight of Arkon P-115 (hydrogenated styrene resin manufactured by Arakawa Rinsan Kagaku Kogyo Kabushiki Kaisha), 15 parts by weight of palmitic N-dodecylamide and 25 parts by weight of Evaflex 310 (ethylene-vinyl acetate copolymer manufactured by Mitsui Polychemical Kabushiki Kaisha) were dissolved under agitation in 900 parts by weight of heated toluene, and 260 parts by weight of triiron tetroxide and 10 parts by weight of carbon black were incorporated and dispersed in the solution for 30 minutes by a homogenizing mixer to obtain a dispersion for spray drying. In the same manner as described in Example 1, a toner was prepared from this dispersion. When the copying operation was carried out by using the so prepared toner, a fixed image having good quality and high density but being free of fogs was obtained without occurrence of the off-set phenomenon. The fixed image had a high adherence and a high resistance to peeling by bending. Thus, it was confirmed that the toner had a good fixing property.

EXAMPLE 5

A composition comprising 60 parts by weight of Arkon P-100 (hydrogenated styrene resin manufactured by Arakawa Rinsan Kagaku Kogyo Kabushiki Kaisha), 10 parts by weight of Epiclon 4050 (epoxy resin manufactured by Dainippon Ink Kagaku Kogyo Kabushiki Kaisha), 10 parts by weight of Victoria Blue stearate (salt prepared from 1 part by weight of Victoria Blue Base and 5 parts by weight of stearic acid) and 20 parts by weight of Evaflex 450 (ethylene-vinyl acetate copolymer manufactured by Mitsui Polychemical Kabushiki Kaisha) was dissolved in 800 parts by weight of heated toluene under agitation, and 250 parts by weight of triiron tetroxide and 18 parts by weight of carbon black were incorporated and dispersed in the solution for 30 minutes by a homogenizing mixer to obtain a dispersion for spray drying. In the same manner as described in Example 1, a toner was prepared from this dispersion. The copying operation was carried out by using the so prepared toner. A fixed image having a high contrast and being free of fogs was obtained without occurrence of the off-set phenomenon.

EXAMPLE 6

A composition comprising 50 parts by weight of Arkon P-125, 10 parts by weight of Epiclon 4050, 20 parts by weight of Diamit 0-200 and 20 parts by weight of Evaflex 420 was dissolved under agitation into 800 parts of heated toluene, and 240 parts by weight of triiron tetroxide and 15 parts by weight of carbon black were incorporated and dispersed in the solution for 30 minutes by using a homogenizing mixer to form a dispersion for spray drying. The dispersion being maintained at 70° C. was sprayed into a hot air current heated at 150° C. to obtain dry spherical particles. Then, 0.08 part by weight of carbon black was added to the particles and the mixture was uniformly blended by a V-type mixer. The resulting particles were classified to collect particles having a particle size of 5 to 15 $\mu$. By using the so obtained toner, an electrostatic latent image on a zinc oxide photosensitive paper was developed to obtain a powder image, and the powder image was transferred onto a transfer paper and fixed by pressing metal rollers. A fixed image having a high contrast and being free of fogs was obtained.

What we claimed is:

1. A pressure fixing developer for electrostatic photography comprising a finely divided magnetic material and a binder as effective components and consisting essentially of substantially spherical particles of said finely divided magnetic material dispersed in a solid medium of said binder, said binder medium being composed of a resin composition comprising (a) 25 to 65% by weight based on the total binder of a hydrogenated styrene resin, (b) 5 to 45% by weight based on the total binder of a wax having a melting point of at least 60° C. and (c) 10 to 30% by weight based on the total binder of a copolymer of an olefin with a carbonyl group-containing, ethylenically unsaturated monomer.

2. A pressure fixing developer as set forth in claim 1 wherein the resin composition constituting the resin binder further comprises (d) up to 20% by weight based on the total binder of a thermosetting resin modifier.

3. A pressure fixing developer as set forth in claim 2 wherein the thermosetting resin modifier is an epoxy resin having an epoxy equivalent of 400 to 3000.

4. A pressure fixing developer as set forth in claim 1 wherein the hydrogenated styrene resin has a hydrogenation degree of at least 30%, a molecular weight of 500 to 1000 and a softening point of 85° to 150° C.

5. A pressure fixing developer as set forth in claim 1 wherein the wax is a higher fatty acid or a derivative thereof.

6. A pressure fixing developer as set forth in claim 5 wherein the higher fatty acid derivative is a higher fatty acid amide.

7. A pressure fixing developer as set forth in claim 5 wherein at least a part of the wax is a salt-forming reaction product prepared from an amino group-containing dye or dye base and a higher fatty acid in an amount of 4 to 20 moles per mole of the dye or dye base.

8. A pressure fixing developer as set forth in claim 1 wherein said copolymer comprises 70 to 97 mole % of olefin recurring units and 3 to 30 mole % of carbonyl group-containing monomer units.

9. A pressure fixing developer as set forth in claim 8 wherein said copolymer is an ethylene-vinyl acetate copolymer.

10. A pressure fixing developer as set forth in claim 1 wherein the finely divided magnetic material is present in an amount of 100 to 350 parts by weight per 100 parts by weight of the binder medium.

11. A pressure fixing developer as set forth in claim 1 wherein said spherical particles contain carbon black dispersed in said binder medium in an amount of 5 to 25% by weight based on the binder medium.

12. A pressure fixing developer as set forth in claim 1 wherein said spherical particles are prepared by spray-drying a starting liquid formed by dispersing said finely divided magnetic material in a solution of said binder in an organic solvent, and said particles have porous rough surfaces having fine convexities and concavities.

13. A pressure fixing developer as set forth in claim 1 wherein on the surfaces of said spherical particles, a phase (1) composed mainly of said wax and a phase (2) composed mainly of the carbonyl group-containing olefin copolymer are present in such mingled state that one of said two phases (1) and (2) is present as a continuous phase and the other phase is present as a dispersed phase, and pores and concavities are formed on the wax phase (1).

14. A process for the preparation of pressure fixing developers for electrostatic photography comprising spraying in a drying atmosphere a starting liquid formed by dispersing a finely divided magnetic material in a solution of a binder in an organic solvent, said binder being composed of a resin composition comprising (a) 25 to 65% by weight based on the total binder of a hydrogenated styrene resin, (b) 5 to 45% by weight based on the total binder of a wax having a melting point of at least 60° C. and (c) 10 to 30% by weight based on the total binder of a copolymer of an olefin with a carbonyl group-containing, ethylenically unsaturated monomer and said organic solvent being capable of dissolving all the components of the binder and having substantially constant volatility and dissolving power, thereby to obtain substantially spherical particles of said finely divided magnetic material dispersed in a medium of said binder, at least surfaces of said spherical particles having a porous structure including fine convexities and concavities.

15. A process according to claim 14 wherein the resin composition constituting the resin binder further comprises (d) up to 20% by weight based on the total binder of a thermosetting resin modifier.

16. A process according to claim 14 wherein the organic solvent is an aromatic hydrocarbon.

17. A developer for electrostatic photography consisting essentially of a dry blend of (A) substantially spherical fixing magneto-sensitive particles comprising as effective component a binder and a finely divided magnetic material dispersed in a medium of said binder and (B) flowability- and electric resistance-controlling fine particles having a volume resistivity not higher than $10^{12}\Omega$-cm and a particle size not larger than 1/10 of the particle size of the substantially spherical particles (A), said binder of the substantially spherical particles (A) being composed of a resin composition comprising (a) 25 to 65% by weight based on the total binder of a hydrogenated styrene resin, (b) 5 to 45% by weight based on the total binder of a wax having a melting point of at least 60° C. and (c) 10 to 30% by weight based on the total binder of a copolymer of an olefin with a carbonyl group-containing, ethylenically unsaturated monomer, and said substantially spherical particles (A) having porous surfaces having fine convexities and concavities formed by spraying a dispersion of said composition into a drying atmosphere.

18. A developer as set forth in claim 17 wherein the resin composition constituting the resin binder of the substantially spherical particles (A) further comprises (d) up to 20% by weight based on the total binder of a thermosetting resin modifier.

* * * * *